US005967353A

United States Patent [19]

Gerhard

[11] Patent Number: 5,967,353

[45] Date of Patent: Oct. 19, 1999

[54] TANK CONTAINER

[75] Inventor: Till Gerhard, Kirchen, Germany

[73] Assignee: Gerhard Engineering GmbH, Weitefeld, Germany

[21] Appl. No.: 09/046,532

[22] Filed: Mar. 24, 1998

[30] Foreign Application Priority Data

Apr. 2, 1997 [DE] Germany ..... 297 05 851 U

[51] Int. Cl.[6] ..... B65D 88/00

[52] U.S. Cl. ..... 220/1.5; 220/4.12

[58] Field of Search ..... 220/1.5, 4.12; 410/77

[56] References Cited

U.S. PATENT DOCUMENTS

| | | | |
|---|---|---|---|
| 4,307,812 | 12/1981 | Gerhard | 220/1.5 |
| 4,381,062 | 4/1983 | Taquoi | 220/1.5 X |
| 4,421,243 | 12/1983 | Taquoi | 220/1.5 |
| 4,593,832 | 6/1986 | Gerhard | 220/1.5 |
| 5,163,572 | 11/1992 | Gerhard | 220/1.5 |
| 5,188,252 | 2/1993 | Gerhard | 220/1.5 |

FOREIGN PATENT DOCUMENTS

| | | |
|---|---|---|
| 0 425 190 | 5/1991 | European Pat. Off. . |
| 0 654 421 | 8/1997 | European Pat. Off. . |
| 2 185 137 | 12/1973 | France . |
| 2 481 678 | 11/1981 | France . |
| 1-139382 | 5/1989 | Japan . |
| 1 468 665 | 5/1974 | United Kingdom . |

*Primary Examiner*—Steven Pollard
*Attorney, Agent, or Firm*—Foley & Lardner

[57] ABSTRACT

In a tank container, the saddle connection between the tank 16 and each container end frame 10 consists of only two structural elements of simple design, i.e. an end ring 17 which is formed by a cylindrical tubular piece and welded to an area of the tank bottom 19 remote from the axis, and a saddle ring 18 which is shaped as a profile ring and welded to the inner surface of the end frame 10. The end of the end frame 17 facing the frame and an axial flange 23 of the saddle ring 18 are welded together after any lengthwise tolerances between the tank 16 and the end frame 10 have been compensated. The peripherally continuous cylindrical end ring 17 and the peripheral continuous saddle ring 18, due to the fact that they are welded together and connected to the tank bottom 19 and the end frame 10, result in an overall torsion-resistant structure which requires no diagonal elements in the end frame even for large containers.

3 Claims, 2 Drawing Sheets

TANK CONTAINER

BACKGROUND OF THE INVENTION

In tank containers, the connection between tie tank and the container frame is often done by means of saddle elements which are welded to the tank, on the one hand, and to diagonal struts inserted in the container frame, on the other hand. Examples of this type of tank saddle structure are found in U.S. Pat. No. 4,593,832, European Patent Application Publication No. 0,425,190 and U.K. Patent No. 1,468,665.

In a further design known from U.S. Pat. No. 4,421,243, which also requires diagonal struts provided in the frame, the cylindrical tank envelope extends continually from one end frame to the other and is butt welded to the respective diagonal struts, with the tank bottoms being fitted into the tank envelope.

A disadvantage of this design resides in the fact that the diagonal struts required in both end frames increase the amount of material used, the manufacture expenditure and the tare weight of the tank container.

Diagonal struts in an end frame have the further disadvantage that they do not permit a simple mounting of a ladder which is to be provided there. Instead, since the ladder is required to be disposed within the container length defined by the end frames, it must be made of specially shaped individual parts to be fir into the spaces left free by the diagonal struts and outer frame members. Moreover, diagonal struts crossing the area of the ladder impair the usability and operational safety of the ladder.

U.S Pat. No. 4,307,812 discloses another saddle structure which in practice is often employed with tank containers. In this structure, the tank in the region of its bottom ends is connected to the respective end frame by means of four saddle pieces each of which is formed as a shell element shaped from a sheet metal blank, with one edge welded to a reinforcing ring surrounding the tank and opposite edges welded to the transverse bars and corner struts of the end frame. If such shell-type saddles are used, no diagonal struts are necessary in the end frames. One difficulty, however, resides in the fact that the shell-type saddles due to their specific shape are expensive to manufacture and require different forming for every tank diameter.

European Patent Specification No. 0,654,421 discloses a tank container having a pair of end frames and a substantially cylindrical tank, the curved bottoms of which are connected to each of the end frames via a saddle structure which comprises an end ring mounted on the tank bottom and a saddle ring connecting the end ring to the end frame. This type of connection between the tank and the container frames, in which the end frames may be free of diagonal elements, is suitable for small and medium size containers.

BRIEF SUMMARY OF THE INVENTION

It is the object of the invention to provide a tank container with a saddle structure and frame of a strength and stiffness sufficient also for large containers—e.g, containers having a height of 8 ft 6 in (approx. 2,590 mm) and a length of 20 ft (approve 6,060 mm)—at minimum material expenditure.

The invention accomplishes this object by a tank container which comprises a pair of end frames which are free of diagonal elements, a substantially cylindrical tank having curved bottoms, and saddle structures connecting each of the bottoms of the tank to the respective end frame, each saddle structure including an end ring mounted on the respective tank bottom and a saddle ring connecting the end ring to the respective one of the end frames, the end ring being formed as a cylindrical tubular piece and the saddle ring being formed as a continuous profile ring having an axial flange connected to the end ring and a radial flange connected to the respective end frame.

The saddle structure connecting the tank to the respective container end frame thus consists of only two structural elements, i.e. an end ring in the form of a cylindrical tubular piece and a saddle ring formed by a peripherally continuous profile ring. Both of these structural elements are available standard parts; the tubular piece may be formed from flat sheet steel by bending to the required diameter and welding.

Tolerances in the axial direction may be compensated by moving the tubular piece welded to the tank bottom relative to the angular ring welded to the end frame before these parts are overlap welded to each other.

The fact that both saddle elements are peripherally continuous, together with the angular cross-section of the saddle ring results in a solid structure of sufficient torsional stiffness.

Each saddle ring preferably includes two outward extending radial flanges welded to surfaces of frame elements facing the container. Due to this structure, the saddle ring itself has the reinforcing function of the conventional diagonal struts.

In another preferred embodiment, the end frames include transverse and upright frame members and the saddle ring has a hollow profile with an outer axial flange which is cut-away in the area of the upright members thereby forming openings, wherein edges of the openings are welding to the upright members. This results in a particularly high stiffness even if the profile has walls of comparatively small thickness.

It is advantageous with respect to strength and to avoiding corrosion if the saddle ring is welded to all four end frame members along edges of openings in the outer axial flange.

In accordance with another embodiment of the invention, the saddle ring has an angular profile forming a radial flange which is overlap welded to a surface of the end frame facing the tank. In this case, the end frames are completely open so that the overall tank is less problematic to be insulated, even, in its end portions, and the above-explained difficulties of installing a ladder in the end frame are overcome.

Sufficient strength is achieved by providing the angular saddle ring with a wide radial flange which exceeds the profile of the frame—in ISO containers at the outer sides of both upright frame members—with the protecting portions being cut-away.

Preferably, the end ring, which consists of a tubular piece, is welded to a portion of the tank bottom relatively remote front the tank axis. The angle between the tubular piece and the tank bottom should be at least 15° to permit welding in the inner region (in addition to welding to be performed at the outer side), such inner welding being specifically useful to avoid corrosion of black steel.

DETAILED DESCRIPTION OF PREFERRED EMBODIMENTS

Figure 1:
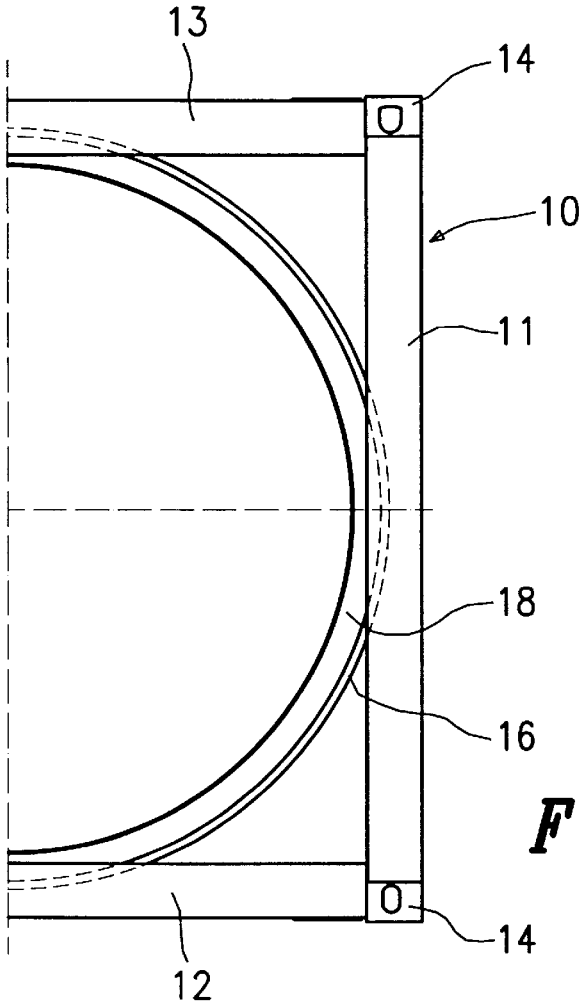
FIG. 1 is a half end view of a tank container.

In accordance with FIG. 1, the end frame 10 of the tank container consists of two corner uprights 11 (only one being shown) interconnected by a lower transverse bar 12 and an upper transverse bar 13, each through a corner fitting 14.

Figure 2:
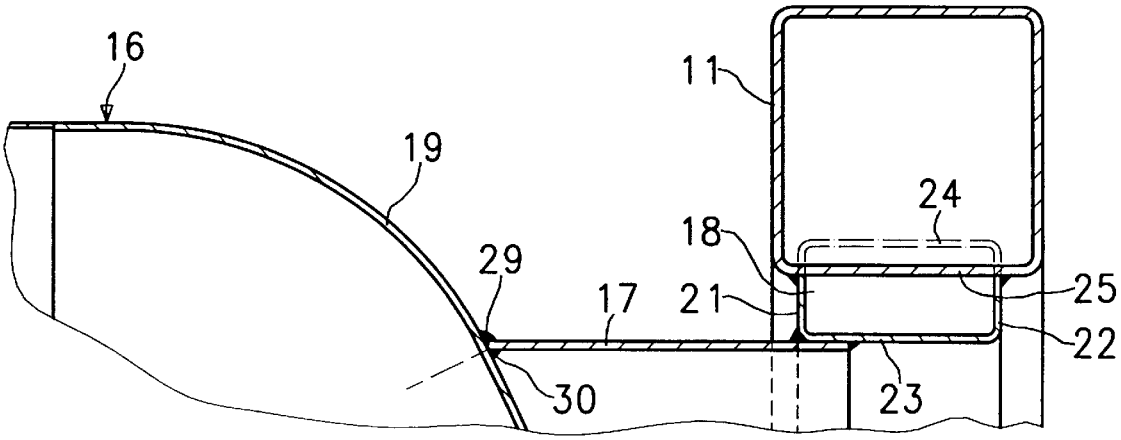
FIG. 2 is a partial longitudinal section through the saddle are of the container shown in FIG. 1.

As shown in FIG. 2, the saddle structure which connects the tank 16 to the respective end frame 10 consists of an end ring 17 and a saddle ring 18. The end ring 17 is formed from a cylindrical tubular piece, which may be bent from flat sheet steel and has one of its ends welded to the tank bottom 19.

The saddle ring 18 has a rectangular hollow profile including two radial flanges 21, 22 and two axial flanges 23, 24. The inner axial flange 23 is overlap welded to the other end of the end ring 17.

As is shown in FIGS. 1 and 2, the saddle ring 18 has portions of the outer axial flange 24 and both radial flanges 21, 22 cut-away in the areas of the corner uprights 11 and the transverse bars 12, 13 of the end frame so that rectangular openings 25 are formed in the profile of the saddle ring. Along the edges of these openings 25, the saddle ring 18 is welded to those inner surfaces of all four end frame elements which face the tank axis whereby the openings 25 are closed.

During assembly, the two end frames 10 are arranged at a spacing corresponding to the desired container length. At this stage, the overlap between the end ring 17 and the saddle ring 18 permits any tolerances to be compensated. Subsequently, the two rings are interconnected by means of outer and inner welds 29, 30.

Figure 3:
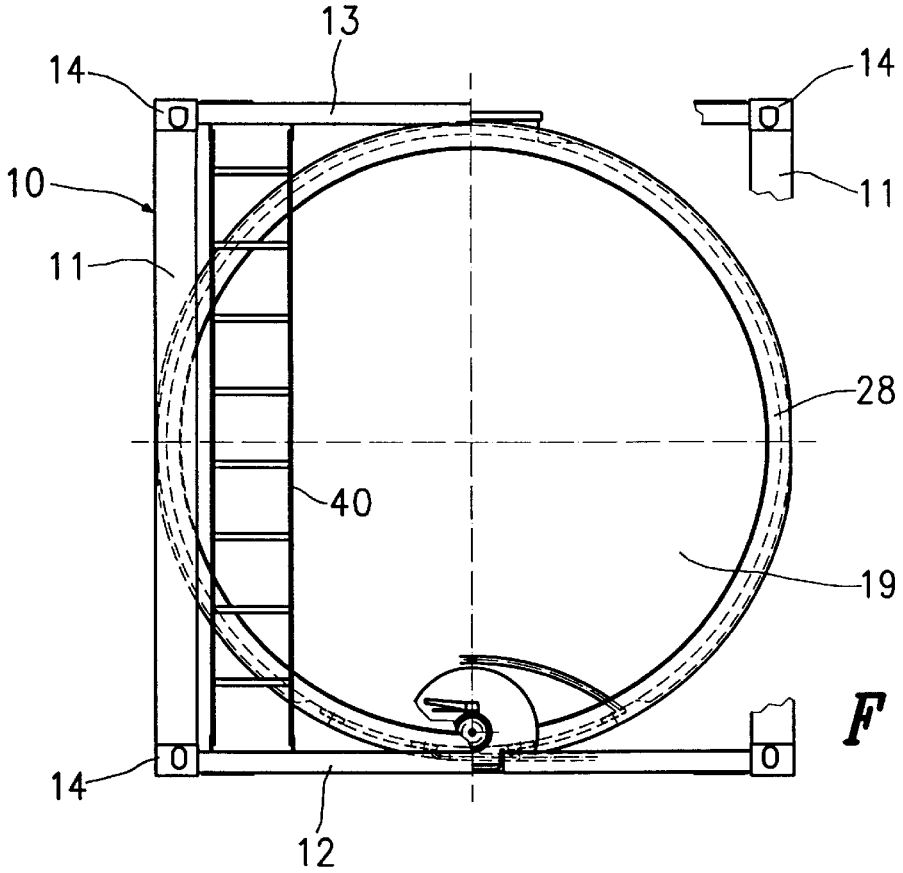
FIG. 3 is an end view of a tank container according to a second embodiment.
Figure 4:
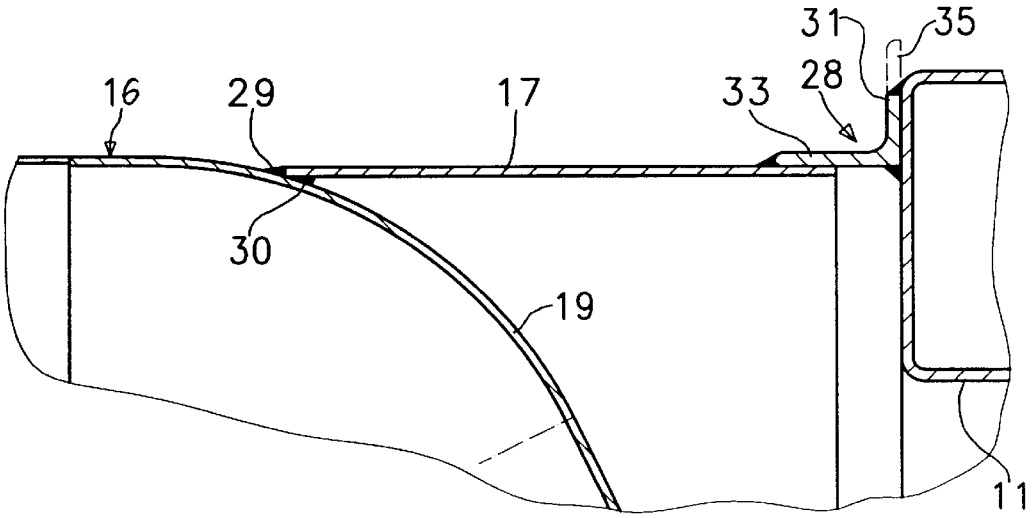
FIG. 4 is a partial longitudinal section through the saddle area of the container shown in FIG. 3.

In the embodiment of FIGS. 3 and 4, the saddle ring 28 is formed as an angular-profile ring having a radial flange 31 and an axial flange 33. The axial flange 33 is overlap welded to the surface of the end frame 10 facing the tank, and the radial flange 31 is overlap welded to the outer end of the end ring 17.

FIG. 4 shows the connection between the saddle ring 28 and a corner upright 11 of the container end frame in a horizontal cross-sectional plane containing the container axis. The portion 35 of the radial flange 31 of the saddle ring 28, which in this area protects beyond the container profile, has been removed.

The diameter of the end ring 17 is selected with respect to the tank diameter such that the angle at the mounting location is no smaller than about 15°. With this angle, an inner weld 30 can be provided in addition to the outer weld 29 to reduce the danger of corrosion.

A ladder 40 is installed between the lower and upper transverse bars 12, 13, the ladder being disposed within the width of the end frame elements 11 to 13 as seen in the axial direction of the container. The ladder 40 is cut to length from stock and screwed or welded to mounting lugs provided on the upper and lower transverse bars 13, 12.

I claim:

1. A tank container comprising:

a pair of end frames which are free of diagonal elements;

a substantially cylindrical tank having curved bottoms; and saddle structures connecting each of the bottoms of said tank to a respective one of said end frames, each saddle structure including an end ring mounted on the respective tank bottom and a saddle ring connecting said end ring to the respective end frames, said end ring being formed as a cylindrical tubular piece and said saddle ring being formed as a continuous profile ring having an axial flange connected to said end ring and a radial flange connected to said respective end frame, wherein said saddle ring includes two outward radial flanges welded to surfaces of elements constituting said end frame facing said container, wherein said end frames include transverse and upright frame members and said saddle ring has a hollow profile with an outer axial flange which is cut-away in the area of said upright members, thereby forming openings, and wherein edges of said openings are welded to said upright members.

2. The tank container of claim 1, wherein said saddle ring is welded to all four end frame members along edges of openings in said outer axial flange.

3. A tank container comprising:

a pair of end frames which are free of diagonal elements;

a substantially cylindrical tank having an axis and curved bottoms; and saddle structures connecting each of the bottoms of said tank to a respective one of said end frames, each saddle structure including an end ring mounted on the respective tank bottom and a saddle ring connecting said end ring to the respective end frames, said end ring being formed as a cylindrical tubular piece and said saddle ring being formed as a continuous profile ring having an axial flange connected to said end ring and a radial flange connected to said respective end frame, wherein said saddle ring includes two outward radial flanges welded to surfaces of elements constituting said end frame facing said tank axis.

* * * * *